United States Patent [19]

Fong

[11] Patent Number: 4,797,966

[45] Date of Patent: Jan. 17, 1989

[54] ANTI-ELECTROSTATIC BRUSH

[75] Inventor: James C. Fong, Taipei, Taiwan

[73] Assignee: Tong-Fong Brush Factory Co., Ltd., Taiwan

[21] Appl. No.: 63,890

[22] Filed: Jun. 19, 1987

[51] Int. Cl.[4] ..... A46B 9/08

[52] U.S. Cl. ..... 15/186; 15/1.5 A; 15/159 A; 132/219; 361/221

[58] Field of Search ..... 15/1.5 R, 1.5 A, 159 R, 15/159 A, 186, 187, 188; 132/11 R, 85; 361/221

[56] References Cited

U.S. PATENT DOCUMENTS

| | | | |
|---|---|---|---|
| 2,426,315 | 8/1947 | Marick | 15/159 R |
| 4,114,222 | 9/1978 | Seredivk | 15/186 |
| 4,290,438 | 9/1981 | Price | 132/11 R |
| 4,500,939 | 2/1985 | Gueret | 15/159 A |
| 4,549,559 | 10/1985 | Gueret et al. | 132/11 R |

*Primary Examiner*—Peter Feldman

*Attorney, Agent, or Firm*—Armstrong, Nikaido & Kubovcik

[57] ABSTRACT

An anti-electrostatic brush comprising handle means (1,3:1', 3') leading to receiving means for bristle support means (2,2') with said support means being located in the receiving means and having bristles (21, 21') extending therefrom, characterized in that the bristle support means (2,2') is electrically conductive and has an extension portion (22') or extension portions (22) extending towards the handle means (1,3:1', 3') and to a region (23, 23') where said portion(s) will be contacted by the hand of a user during normal brushing operations.

15 Claims, 4 Drawing Sheets

ANTI-ELECTROSTATIC BRUSH

The present invention relates to an anti-electrostatic brush featuring the elimination or minimization of electrostatic charges resulting during the brushing process by means of a discharge conductive contact unit preferably located at two sides of the brush neck.

Electrostatic charges will be produced because of the friction of hair with the brush bristles during the brushing process. As a result, hair will fly and a proper brushing effect is not achieved. Furthermore, such charges may cause the hair to split, break or fall out and damage to hair quality. Meanwhile, the hair brush carrying electrostatic charges will frequently absorb dust from the hair and easily become dirty.

According to the present invention there is provided an anti-electrostatic brush comprising handle means leading to receiving means for bristle support means with said support means being located in the receiving means and having bristles extending therefrom characterized in that the bristle support means is electrically conductive and has an extension portion or extension portions extending towards the handle means and to a region where said portion(s) will be contacted by the hand of a user during normal brushing operations.

In one embodiment of the invention an extension of the electrically conductive support means extends continuously to the hand engaging surfaces preferably in the neck region of the brush. In another embodiment, an extension extends only as far as an electrically conductive insert member which itself extends to the hand engaging surfaces. Said hand-engaging surfaces in such embodiment may be the material of the extension or insert or an overlying electrically conductive face member which may be of more durable and/or attractive appearance.

The purpose of the subject creation is to provide an anti-electrostatic hair comb or brush to eliminate or minimise electrostatic charges by means of an electrically conductive contact unit located at the two sides of the brush nech which will cause a discharge circuit or path when being held by a person so as to avoid or minimize accumulation of har dirt and contaminants on the bristles and to avoid or reduce interference of electrostatic charge to the hair.

The invention will be described further, by way of example, with reference to the accompanying drawings, in which.

Figure 1:
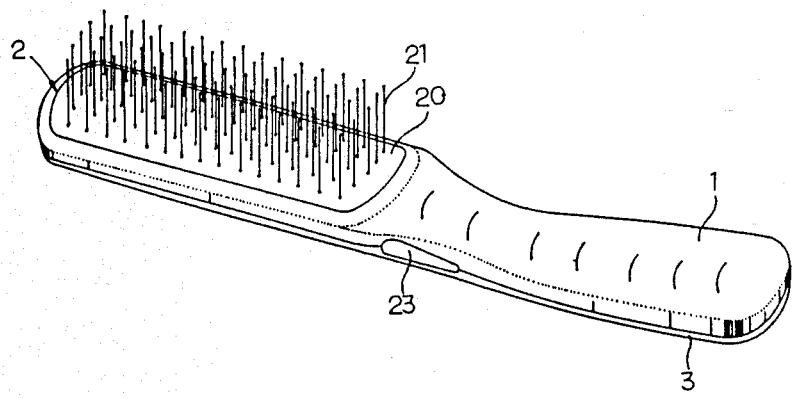
FIG. 1 is a perspective view of an anti-electrostatic brush forming a first embodiment of the invention.
Figure 3:
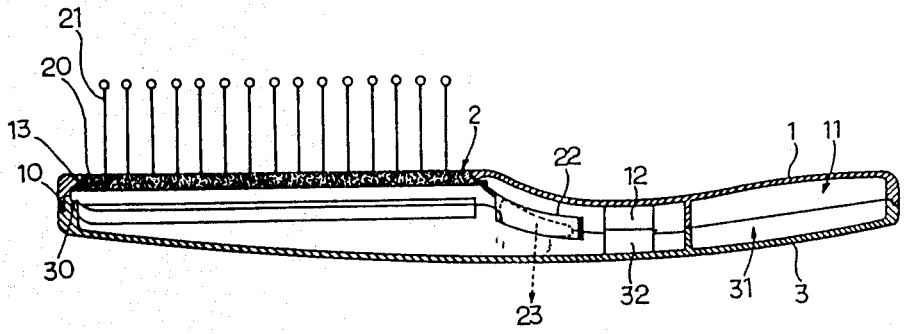
FIG. 3 is a longitudinal sectional view of the brush of FIGS. 1 and 2.
Figure 2:
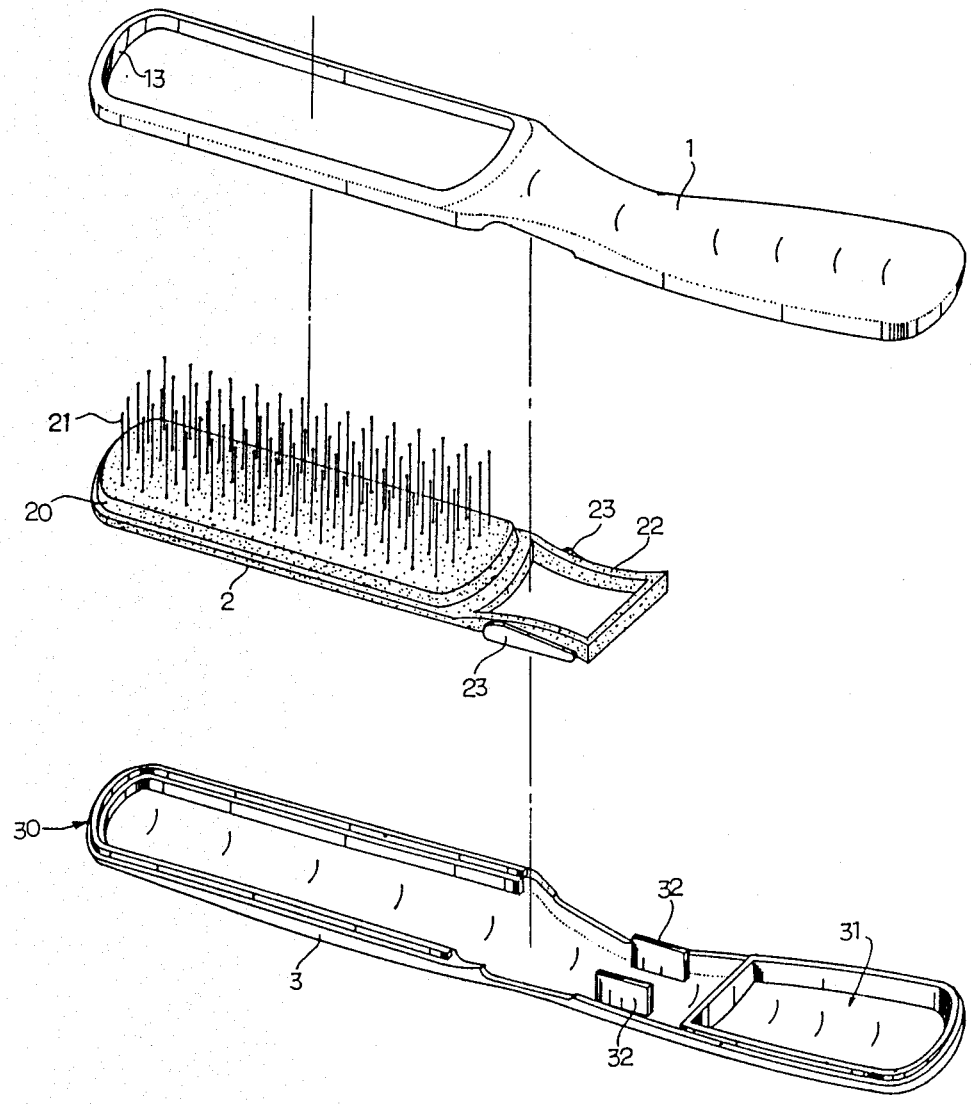
FIG. 2 is an exploded perspective view of the brush of FIG. 1.
Figure 4:
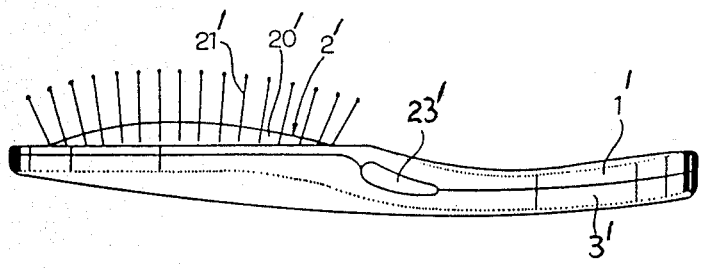
FIG. 4 is a side elevation of a brush forming a second embodiment of the invention wherein a bristle carrier member has an extension which abuts a second conductive member.
Figure 6:
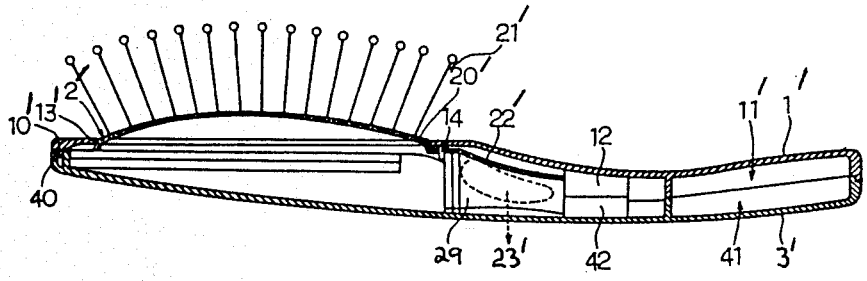
FIG. 6 is a longitudinal section of the brush of FIG. 4.

A first embodiment of an anti-electrostatic brush is illustrated in FIGS. 1 to 3 and comprises two interengageable housing parts 1 and 3 which together form a brush handle part and housing means for a brush bristle (needle) carrier member 2. The two housing parts 1 and 3 have peripheral interengaging means and securement, at the front end, is partially by way of an indentation or groove 10 on housing part 1 cooperable with projection means on housing part 3 in snap-fit manner. Elongate reinforcing portions are provided as is apparent.

In the region of the handle portion of housing part 3 is a generally rectangular recess or channel portion 11 on an edge of which are corresponding elongate projections or reinforcing members 12. A rectangular opening 13 is provided in the portion of housing part 3 remote from the handle and had tapered side walls, at least at opposite ends, converging towards the normally outer surface of the housing and retainably receiving the flexible, brush bristle carrier member 2 which has cooperating inclined edge faces.

The bristle carrier member 2 includes a plurality of brush needles or bristles 21 embedded or implanted therein in the bristle receiving portion 20 and has connection parts 22 on two opposite sides of which are electrically conductive contact parts 23. The member 2, i.e. the combined connection parts 22 and bristle receiving portion 20 have incorporated therein on thereon electrically conductive materials such as metal powder, etc. to conduct electric charges (current) from the bristles 21 to contact part 23.

The housing part 3 has a projecting peripheral flange 30 which has portions which cooperate with groove 10 of part 1 to secure the two parts together. Part 3 has a generally rectangular recess 31, generally corresponding to recess 11, elongate identical reinforcing members 32 corresponding to and abutting members 12.

The normally abutting edges of housings 1 and 3 have recesses which together from apertures on either side of the brush and into which apertures the parts 23 extend so as, in use, to be contacted by the hand of a user.

To assemble, the brush bristle receiving portion 20 is secured in the opening 13 of the housing part 1 and the housing part 3 is correspondingly secured to the housing part 1. The electrically conductive parts 23 are located in the apertures provided at the two sides of the brush neck which facilitates the gripping of the user, so as to provide a discharge circuit or path to eliminate or minimize electrostatic charges created during the brushing process and to avoid attraction of dust and dirt, and to protect hair quality.

The embodiment of FIGS. 4 to 7 is similar to that of FIGS. 1 to 3 and similar parts have similar reference numerals. However, the main difference in this embodiment, apart from the overall shape of the brush, is the provision of two electrically conductive components (2' and 29) as will be described.

Figure 7:
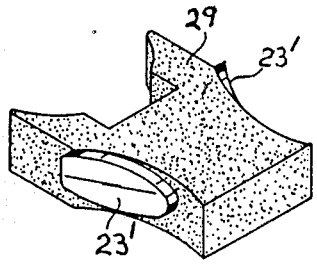
FIG. 7 is a perspective view of an electrically conductive brushing insert.
Figure 5:
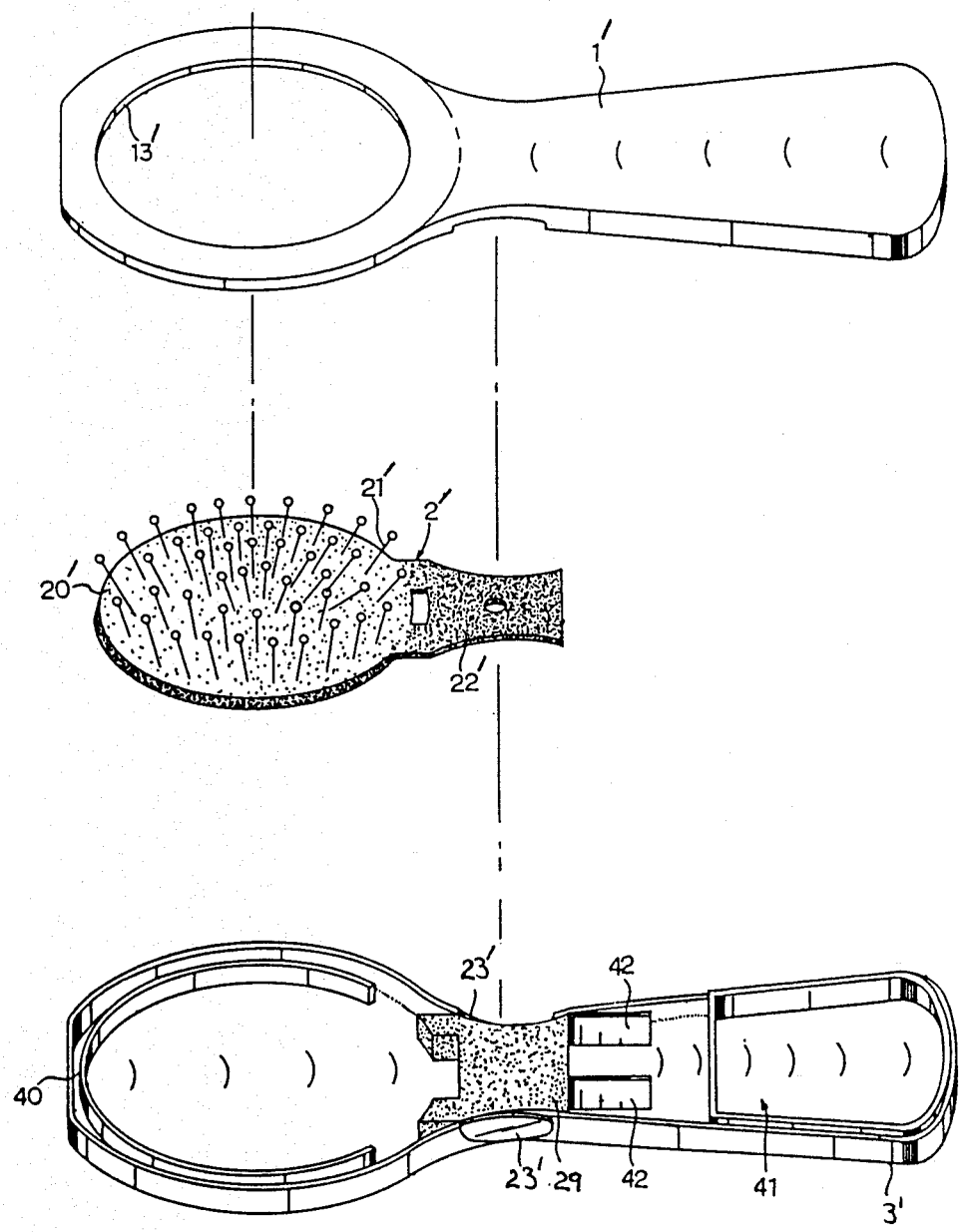
FIG. 5 is an exploded perspective view of the brush of FIG. 4 turned through 180°.

The anti-electrostatic brush comprises a first housing part 1' and a second housing part 3', a brush bristle carrier member 2' and a fixed electrically conductive part 29. The two housing parts 1' and 3' are corresponding and cooperating parts, the front of the housing part 1' is fitted with protruding post 10' that serves as a catch. The front of the handle is a square idented groove 11' at which edge are two corresponding elongate pieces 12' to serve as reinforcement, and there is an opening 13' with tapered periphery near the protruding post 10. In a central region of part 1' is a stop piece 14 which engages in flexible carrier member 2' which includes a plurality of bristles 21' embedded in the bristle implanted portion 20'. The two sides of carrier member 2' are inclined outwardly, and a connecting portion 22' has an aperture into which is snapped in place the stop piece 14 of the said housing part 1' to locate said portion. The combined bristle implanted portion 20' and the connecting portion 22' are electrically conductive such as by having added current conducting materials such as metal powder, etc. The fixed rubber insert 29 is also electrically conductive by, for example, having added electrically conductive materials and on two sides of the insert 29 are electrically conductive contacts 23' which conductively connect with the bristles 21 to become an integrated and conductive unit - as shown in FIG. 7. The housing 3' also has corresponding projection or protruding post 10' on the housing part 1', rectangular indented channel and indented groove 40, rectangular recess 41 and a pair of identical, elongate pieces 42.

To assemble the brush, the bristle portion 20' is located in opening 13' of the housing part 1' by means of the inclination of the two sides. The rubber insert 29 is located in the housing 3' and stopped against movement into the handle by the elongate pieces 42'. The corresponding housing part 3' is connected with the part 1'. The connecting portion 22' is securely connected to the insert 29 so as to conduct current to the contact surfaces 23' located on the two sides of the brush neck, to produce an electrostatic discharge path when a person's hand holds the handle in use. The brush eliminates or minimizes electrostatic charges and retention of dush and stains during combing process. The embodiment enables the minimization of the amount of material of the conductive portion in a hollow hair brush to save production materials and reduce the costs.

The brush according to the invention can avoid or minimize electrostatic charges caused by friction and the conductible portion which is in a hollow shape is minimized to reduce production costs for materials. Meanwhile, the brush housing part can have a combination of various colours to add beautiful appearance to the streamlined brush body. The anti-electrostatic hair brush is extremely practicable and convenient.

Features of the brush according to the invention include the elimination of electrostatic charges produced during the brushing or combing process, by means of a discharge circuit resulting from a person's holding the contact unit 23 at two sides of the brush neck, to avoid or minimize accumulation of stains in the brush bristle and to protect hair quality. The inventive concept can equally well be applied to a comb or other similar devices.

I claim:

1. An anti-electrostatic brush comprising:

an electrically conductive bristle receiving means receiving a plurality of bristles thereon, said bristle receiving means being provided with a contact part;

a first housing part having a first opening at one end thereof and a first handle portion at the other end thereof, said first opening being slightly smaller than said bristle receiving means, said first housing part being provided with a first engagement means; and a second housing part having a means for receiving said bristle receiving means at one end thereof and a second handle portion at the other end thereof, said second housing part being provided with a second engagement means to be engaged with said first engagement means securing the first and second housing parts together, wherein at least one of first and second housing parts has a second opening at the handle portion thereof, through which second opening said contact part of said bristle receiving means is exposed to the surface of said handle portion.

2. A brush as claimed in claim 1, in which the bristle receiving means is made of electrically conductive material or has such material incorporated therein or applied to the surface thereof.

3. A brush as claimed in claim 2, in which the bristle receiving means has an extension portion or portions including electrically conductive material to conduct electrical current from the bristles to the contact part.

4. A brush as claimed in claim 1, in which the bristle receiving means is made of flexible material which is adapted to be electrically conductive.

5. A brush as claimed in claim 1, in which the contact part has an electrically conductive facing portion formed thereon or an electrically conductive facing member applied thereto.

6. A brush as claimed in claim 1, in which the first opening has side walls converging towards the outside of the brush and the bristle receiving means has a portion seatable therein and a rim to retain such in position.

7. A brush as claimed in claim 6, in which each housing part has aligned projections which abut when assembled to provide reinforcement.

8. A brush as claimed in claim 7, in which the housing parts in the end of the handle portions have recesses partially defined by cross portions.

9. A brush as claimed in claim 3, in which said extension portion or portions extend to the contact part as a continuous extension of the bristle receiving means.

10. A brush as claimed in claim 3, in which one extension portion extends towards the handle and is disposed in electrically conductive relationship with an electrically conductive insert which extends to the region of hand contact for discharge purposes.

11. A brush as claimed in claim 10, in which the insert is of greater thickness than the bristle receiving means.

12. A brush as claimed in claim 11, in which the insert member is shaped to substantially fill the neck cross section region of the interior of the brush and stop members prevent the insert member falling into the handle portion.

13. A brush as claimed in claim 10, in which a projection extends from the first housing part into an aperture in said one extension portion to facilitate location.

14. An anti-electrostatic brush comprising:

a first brush bristle housing, having an indented groove at the front and having in the handle a square indented channel, at which edges are protruding, corresponding elongate pieces to serve as reinfocements and a opening, when viewed from above, with inside tapered angle provided near the indented groove;

a flexible brush bristle carrying part comprising a brush bristle implanted piece with a plurality of brush bristles and a connecting piece that have electrically conductive materials added to conduct the current from the brush bristles to a contact unit, and to secure the brush bristle planting part to the opening at the said brush bristles;

a second housing having an indented groove on the brush bristle piece, a square indented channel and protruding posts, a rectangular flange and a pair of identical elongate pieces, corresponding to the above, all catched and snapped into position, so that the electrically conductive contact unit(s) is located at the two sides of the brush neck.

15. An anti-electrostatic brush, comprising:

a first brush housing part with its front having a protruding post that serves as a catch, on the handle portion is a rectangular indented groove and near which are two corresponding elongate pieces that serve as reinforcement, and near the protruding post is an opening of inward inclination and at which centre is a stop piece that serves as a stop;

a flexible brush bristle part including a bristle carrying portion with a plurality of bristles implanted therein with said bristle part being secured at the opening of the first housing part, a combined connecting portion being snapped into position at the stop piece of the housing and the combined bristle implanted portion and the connecting portions have current conductible materials added thereto;

a second housing part, with corresponding protruding post on the rectangular indented groove, square flange, and a pair of identical elongated pieces which are snapped into position and secured;

a fixing rubber insert having current conductible materials included in its interior and on two sides of which are conductible contact units to secure it inside the housing and snapped by the elongated pieces, so the contact unit is located at two sides of the brush neck, and combined electrically with the brush bristles in series connection.

* * * * *

REEXAMINATION CERTIFICATE (1412th)

United States Patent [19] [11] B1 4,797,966

Fong [45] Certificate Issued Jan. 29, 1991

[54] ANTI-ELECTROSTATIC BRUSH

[75] Inventor: James C. Fong, Taipei, Taiwan

[73] Assignee: Tong-Fong Brush Factory Co., Ltd.

Reexamination Request:
No. 90/002,020, May 10, 1990

Reexamination Certificate for:

| | |
|---|---|
| Patent No.: | 4,797,966 |
| Issued: | Jan. 17, 1989 |
| Appl. No.: | 63,890 |
| Filed: | Jun. 19, 1987 |

[51] Int. Cl.[5] ..... A46B 9/08

[52] U.S. Cl. ..... 15/186; 15/1.52; 15/159 A; 132/219; 361/221

[58] Field of Search ..... 15/1.51, 1.52, 186, 15/187, 188; 361/221; 132/219

[56] References Cited

U.S. PATENT DOCUMENTS

| | | | |
|---|---|---|---|
| 1,748,950 | 3/1930 | Goldberg | 119/93 |
| 2,426,315 | 3/1947 | Marick | 15/159 R |
| 3,651,532 | 3/1972 | Wettburg | 15/186 |

FOREIGN PATENT DOCUMENTS

| | | |
|---|---|---|
| 60-103330 | 7/1985 | Japan . |
| 62-42433 | 3/1987 | Japan . |

*Primary Examiner*—Chris K. Moore

[57] ABSTRACT

An anti-electrostatic brush comprising handle means (1,3:1',3') leading to receiving means for bristle support means (2,2') with said support means being located in the receiving means and having bristles (21,21') extending therefrom, characterized in that the bristle support means (2,2') is electrically conductive and has an extension portion (22') or extension portions (22) extending towards the handle means (1,3:1',3') and to a region (23,23') where said portion(s) will be contacted by the hand of a user during normal brushing operations.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-15 is confirmed.

* * * * *